US008925727B2

(12) United States Patent
Ortenzi et al.

(10) Patent No.: US 8,925,727 B2
(45) Date of Patent: Jan. 6, 2015

(54) DISPOSABLE TRANSDERMAL PATCH PACKAGING

(75) Inventors: Vernon D. Ortenzi, Burlington, KY (US); Robert J. Ziemba, Cincinnati, OH (US); Paul Fearis, Woodstock, MD (US); Brandon Craft, Reisterstown, MD (US)

(73) Assignee: Mallinckrodt LLC, Hazelwood, MO (US)

( * ) Notice: Subject to any disclaimer, the term of this patent is extended or adjusted under 35 U.S.C. 154(b) by 806 days.

(21) Appl. No.: 13/014,876

(22) Filed: Jan. 27, 2011

(65) Prior Publication Data

US 2011/0253572 A1 Oct. 20, 2011

Related U.S. Application Data

(60) Provisional application No. 61/300,170, filed on Feb. 1, 2010.

(51) Int. Cl.
*B65D 69/00* (2006.01)
*B65D 5/00* (2006.01)

(52) U.S. Cl.
CPC ..... *B65D 5/00* (2013.01); *B65D 2209/00* (2013.01)
USPC ..... 206/570; 206/440

(58) Field of Classification Search
USPC ..... 206/438, 440, 828, 570
See application file for complete search history.

(56) References Cited

U.S. PATENT DOCUMENTS

| | | | | |
|---|---|---|---|---|
| 3,033,362 | A * | 5/1962 | Marcalus | 206/494 |
| 4,807,753 | A * | 2/1989 | Goldstein | 206/390 |
| 6,124,522 | A * | 9/2000 | Schroeder | 602/57 |
| 6,796,429 | B2 | 9/2004 | Cameron et al. | |
| 6,905,016 | B2 * | 6/2005 | Kanios et al. | 206/204 |
| 6,923,320 | B2 | 8/2005 | Grossman | |
| 7,086,563 | B2 * | 8/2006 | Maffei | 221/305 |
| 7,521,586 | B2 * | 4/2009 | Schroeder | 602/57 |
| 7,867,511 | B2 | 1/2011 | Anderson et al. | |
| 2004/0122554 | A1 * | 6/2004 | Howard | 700/237 |
| 2005/0256439 | A1 * | 11/2005 | Grossman | 602/57 |
| 2007/0170196 | A1 | 7/2007 | Libohova et al. | |
| 2009/0114671 | A1 * | 5/2009 | Finnestad et al. | 221/102 |

* cited by examiner

*Primary Examiner* — Jacob K Ackun
*Assistant Examiner* — Jenine Pagan
(74) *Attorney, Agent, or Firm* — James L. Johnson; Marsh Fischmann & Breyfogle

(57) ABSTRACT

A transdermal patch container (10) that includes a container body (16), a first compartment (24), and a second compartment (28) is disclosed. One or more first transdermal patches (34) may be stored in the first compartment (24). One or more second transdermal patches (36) may be stored in the second compartment (28). The first transdermal patches (34) differ from the second transdermal patches (36) in at least one respect. A number of features may be incorporated to reduce the potential of being able to withdraw second transdermal patches (36) out of the second compartment (28). For instance, second transdermal patches (36) may be required to be directed through a slot (44) to enter a second compartment (28$^{i}$). A flap (66) may be positioned below such a slot (58) within a second storage compartment (28$^{ii}$). A plurality of vertically spaced or staggered flaps (96) may be positioned within a second storage compartment (28$^{iv}$).

7 Claims, 6 Drawing Sheets

DISPOSABLE TRANSDERMAL PATCH PACKAGING

CROSS-REFERENCE TO RELATED APPLICATIONS

This patent application claims priority to U.S. Provisional Patent Application Ser. No. 61/300,170, entitled "DISPOSABLE TRANSDERMAL PATCH PACKAGING," filed on Feb. 1, 2010, and the entire disclosure of which is incorporated by reference in its entirety herein.

FIELD OF THE INVENTION

The present invention generally relates to the field of transdermal patches and, more particularly, to packaging for such transdermal patches that facilitates disposal of transdermal patches.

BACKGROUND

Abuse, misuse, and overdose of pharmaceutical products (e.g., pain management drugs) are serious health concerns that affect many people on a daily basis all over the world. For instance, diversion and subsequent misuse or abuse may occur when a patient gets a prescription for a pharmaceutical product and does not use all of the pharmaceutical product for whatever reason (e.g., a doctor may prescribe a pharmaceutical product for a patient and advise the patient to take the pharmaceutical product on an "as needed" basis; a patient may be advised to use an entire prescribed amount of pharmaceutical product, but may unilaterally decide to discontinue use of the pharmaceutical product as one or more symptoms disappear). In any case, remaining pharmaceutical product may be ultimately acquired by an individual other than for whom the pharmaceutical product was originally prescribed (e.g., transferred by the original patient to another other individual, such as family member or friend; stolen). While unused pharmaceutical product may be disposed of in the trash, this may not be viewed by some as a secure method of disposal.

In the case of transdermal analgesic patches, a used patch may still retain a significant amount of active ingredient in the patch. A used patch can be very dangerous and can even lead to death for people who have not been prescribed the patch. While some patch manufacturers recommend flushing used patches down the toilet, this practice has raised concerns about drug product entering the water supply. In some states, "take back" programs have been instituted, allowing users to request shipping materials in order to ship used or unused pharmaceutical product (e.g., patches) to a certified disposal company. These programs tend to be costly and require several actions by the patient at multiple times.

SUMMARY

A first aspect of the present invention is generally directed to transdermal patch packaging or a container that includes a container body, a first compartment, and a second compartment. At least one transdermal patch of a first state or condition is located within the first compartment, while at least one transdermal patch of a second state or condition is located within the second compartment. The first and second states or conditions differ in at least some respect. A transdermal patch within the first compartment hereafter may be referred to as a "first transdermal patch," while a transdermal patch within the second compartment hereafter may be referred to as a "second transdermal patch."

A number of feature refinements and additional features are applicable to the first aspect of the present invention. These feature refinements and additional features may be used individually or in any combination. As such, each of the following features that will be discussed may be, but are not required to be, used with any other feature or combination of features of the first aspect of the present invention.

One embodiment has the noted "first condition" of the transdermal patches within the first compartment being that the transdermal patches are new or unused (e.g., not yet having been mounted on or adhered to a patient), with the noted "second condition" of the transdermal patches within the second compartment being that the transdermal patches have been used by a patient (e.g., having been mounted on or adhered to a patient). One embodiment has the noted "first condition" of the transdermal patches within the first compartment being that the transdermal patches are contained within individual primary packaging (e.g., within a sealed pouch, jacket, foil wrapping, or the like), with the noted "second condition" of the transdermal patches within the second compartment being that the transdermal patches are in an exposed state or where the individual transdermal patches have been removed from their associated primary packaging before being disposed within the second compartment. Each of these "exposed" transdermal patches may either have been used by a patient (e.g., having been mounted on or adhered to a patient such that pharmaceutical product was delivered transdermally to the patient) or not (e.g., the second compartment may contain one or more transdermal patches that were removed from their associated primary packaging and disposed in the second compartment before being used by a patient). One embodiment has the noted "first condition" of the transdermal patches within the first compartment being that each of these transdermal patches includes a first amount of pharmaceutical product (e.g., a prescribed dose), with the noted "second condition" of the transdermal patches within the second compartment being that each of these transdermal patches includes a second amount of pharmaceutical product (e.g., something less than that prescribed dose, for instance based upon the transdermal patch having been mounted on or adhered to a patient for a period of time such that at least part of its pharmaceutical product was delivered transdermally to the patient), where the first and second amounts are different.

The first compartment may be sized to accommodate storage of multiple first transdermal patches. Any appropriate number of first transdermal patches may be stored in the first compartment, for instance, a number of first transdermal patches that correspond with a desired "prescription period" and/or a "total prescribed dose." For instance, a patient's prescription may be for a two-week period, where each first transdermal patch is to be used for 48 hours (i.e., a prescription of this type would include 7 first transdermal patches). Each first transdermal patch within the first compartment may be contained within primary packaging (e.g., a sealed pouch or jacket; foiled packaging; packaging that is torn to gain access to a transdermal patch). Unless otherwise noted herein, all discussion regarding a first transdermal patch within the first compartment can be equally applicable to each first transdermal patch within the first compartment.

The second compartment may be sized to accommodate storage of multiple second transdermal patches. Any appropriate number of second transdermal patches may be stored in the second compartment. In one embodiment, the first and second storage compartments are of the same size. In another embodiment, the first storage compartment may be larger than the second storage compartment. In yet another embodiment, the first storage compartment may be smaller than the second storage compartment. Unless otherwise noted herein, all discussion regarding a second transdermal patch within the second compartment can be equally applicable to each second transdermal patch stored within the second compartment.

The first and second compartments may be characterized as being within the container body in at least some respect. The container body may be formed from any appropriate material or combination of materials, such as cardboard (e.g., formed from one or more pieces of cardboard), paperboard, plastic, and the like. Forming the container body from an appropriate plastic or plastic-like material may be preferred since it could increase the difficulty in accessing second transdermal patches within the second compartment. The container body may be of any appropriate size, shape, configuration, and/or type. For instance, the container body may be formed from a single piece of flat material utilizing one or more fold lines and/or one or more die cuts to provide a desired configuration (e.g., a square or rectangular box of sorts). In one embodiment, the transdermal patch packaging includes a lid and a hinge between the lid and container body (e.g., where the hinge is defined along a fold line). Opening the lid may provide access to each of the first and second compartments. Closing the lid may at least partially conceal (and thereby encompassing totally concealing) each of the first and second compartments.

The first compartment of the container body may include a first open end. This first open end may be oppositely disposed from a base of the container body. As such, when the base of the container body is disposed on a supporting surface, the container body is oriented in an upright position with the first open end being located remote from the supporting surface. The first open end of the container body is sized to expose (e.g., provide access to) at least some first transdermal patches within the first compartment. In some cases, this first open end may be sized so as to expose all first transdermal patches within the first compartment. A patient may then simultaneously see or count all of the first transdermal patches in the first compartment.

The second compartment of the container body may include a second open end. This second open end may be oppositely disposed from a base of the container body. As such, when the base of the container body is disposed on a supporting surface, the container body is oriented in an upright position with the second open end being located remote from the supporting surface. The second open end of the container body may be sized to expose (e.g., provide access to) at least some of the second transdermal patches within the second compartment. In some cases, this second open end may be sized so as to expose all second transdermal patches within the second compartment. A patient may then simultaneously access all of the second transdermal patches in the second compartment.

One or more additional features may facilitate the disposal of transdermal patches. The transdermal patch packaging may include a disposal member within the second compartment, and this disposal member may be used in relation to any of the aspects/embodiments of the present invention identified herein. At least one transdermal patch may be bonded to this disposal member (e.g., with the adhesive side of the transdermal patch facing the disposal member). The disposal member may be of any appropriate size, shape, and/or configuration. For instance, the disposal member may be in the form of a card or the like that is disposed into a folded configuration to capture one or more transdermal patches between the folded sections (e.g., the card may be folded over onto itself to dispose at least one transdermal patch therebetween). Such a disposal member may incorporate an appropriate adhesive in any appropriate arrangement to in effect seal one or more transdermal patches within the folded configuration.

The disposal member may be in the form of a sheet or a substrate that includes a plurality of discrete zones or regions, each of which can accommodate a separate transdermal patch. A transdermal patch may be disposed on and bonded to such a disposal member in one of the predefined zones. Although this bond could rely upon remaining adhesive on the transdermal patch, in one embodiment each such zone of the disposal member incorporates adhesive of any appropriate type. This adhesive may be distributed within each zone in any appropriate manner.

In the case where a disposal member itself incorporates adhesive for bonding a transdermal patch thereto, it may be desirable to include a release liner or film. A single release liner or film could be disposed over one or more regions of the disposal member that accommodates a transdermal patch. Another option would be to provide a separate release liner or film for each individual region of the disposal member that accommodates a transdermal patch. Although the disposal member could originally include a plurality of zones or regions for a corresponding number of transdermal patches, the disposal member could be configured so that individual sections thereof could be detached from a remainder of the disposal member, and where each such section accommodates a single transdermal patch.

The transdermal patch packaging may include what is characterized as a cover that is disposed over the second compartment (e.g., so as to at least partially close or enclose the second compartment; the cover being oppositely disposed from the above-noted container body base). This cover may include one or more apertures. Unless otherwise noted herein, all discussion regarding one of these apertures is applicable to each of these apertures. In one embodiment, a cover aperture is sized and/or configured to reduce the potential that a second transdermal patch can be removed from the second compartment through a cover aperture, to impede the ability of an individual to remove a second transdermal patch from the second compartment through a cover aperture, or both.

The second compartment may be in the form of a single space in which one or more second transdermal patches may be stored or disposed. Each of the above-noted cover apertures may then access a common interior space. However, the second compartment could also be subdivided into a plurality of different interior spaces in any appropriate manner, with each subdivided space being accessed by its own cover aperture or set of cover apertures (e.g., there may be a one-to-one relation between cover apertures and subdivided spaces).

Any cover provided over the second compartment may include a plurality of apertures. There may be a separate aperture for each second transdermal patch to be stored in the second compartment (e.g., a one-to-one relation). Each aperture may be of any appropriate size, shape, and/or configuration. For instance, each aperture may be in the form of an axially or linearly extending slot or slit. A cover aperture may be continually open, or a cover aperture may be defined by rupturing or perforating the cover along a predefined path or section (e.g., a scored segment or score-line previously formed in the cover). In the second instance, forming the cover in this manner may provide a visual indication as to how many second transdermal patches are currently within the second compartment. In one embodiment, the number of scored segments of the cover corresponds with the number of second transdermal patches to be stored in the second compartment.

The second compartment may include one or more flaps or tabs that are intended to reduce the potential that a second transdermal patch may be removed from the second compartment through a cover aperture. At least one flap or tab may be disposed below (e.g., at a lower elevation when the transdermal patch packaging is an upright orientation) and at least partially vertically aligned with one or more cover apertures. Consider the case where the second compartment is at least partially defined by a base (e.g., part of the noted container body base), a perimeter wall (e.g., an annular structure or one that extends a full 360° about a common location whether circular, rectangular, square, or the like; collectively part of a container body sidewall and a divider between the first and second compartments; a completely separate structure from a container body sidewall), and the above-noted cover. In one embodiment, the perimeter wall for the second compartment extends upwardly from the base when the transdermal patch packaging is in an upright orientation, such that the cover and base are disposed on and define opposite ends of the second compartment. One or more flaps or tabs may extend from the perimeter wall both toward, but not to, an opposing portion of the perimeter wall, as well as the base. One or more flaps or tabs may extend from an underside of the cover toward, but not to, each of the perimeter wall and the base. Each such flap or tab may be characterized as a cantilever, having a fixed end or portion and an oppositely disposed free end. Each such flap or tab may extend in a downward direction toward the base (and at an angle relative to vertical when the transdermal patch packaging is in an upright orientation) proceeding in the direction of its corresponding free end.

Introducing a second transdermal patch into the second compartment through a cover aperture may deflect one or more flaps or tabs in a first direction (e.g., by engagement of the second transdermal patch with such a flap/tab; moving its corresponding free end at least generally in the direction of the base). In the event that the second transdermal patch ends up being positioned below such a flap or tab, the flap or tab may move at least partially back toward its original position, which would reduce the space through which the second transdermal patch would have to be directed through to be pulled back out of the second compartment through a cover aperture. Contact between a second transdermal patch within the second compartment and one or more flaps/tabs may impede the ability to remove a second transdermal patch from the second compartment through a cover aperture.

Any appropriate number of flaps or tabs may be included in the second compartment, and multiple flaps or tabs may be disposed in any appropriate arrangement. In one embodiment, there are a number of vertically spaced or staggered flaps or tabs in the second compartment (e.g., at least two flaps or tabs may be disposed at different elevations when the above-noted base is positioned on a supporting surface such that the transdermal patch packaging is disposed in an upright orientation). One or more flaps or tabs may be positioned on one side of the perimeter wall, while one or more flaps or tabs may be positioned on an opposite side of the perimeter wall. Flaps or tabs that are positioned on one side of the perimeter wall may be vertically staggered in relation to flaps or tabs that are positioned on an opposite side of the perimeter wall.

The second compartment may also include a plurality of flaps that are disposed at a common elevation when the transdermal patch packaging is in an upright orientation. Each flap or tab may be associated with its own aperture, and the various flaps may be at least generally disposed in a common orientation and/or elevation when the transdermal patch packaging is in an upright orientation. A flap or tab associated with one aperture may also be positioned at a common elevation with a flap or tab that is associated with another aperture (e.g., an adjacent aperture; such flaps or tabs may be spaced a common distance from the above-noted base within the second compartment when the container is in an upright position). Any such pair of flaps may be characterized as being oriented as the mirror image of each other. Any such pair of flaps may also be characterized as converging toward a common location proceeding in a direction of their respective free ends.

One or more flaps or tabs may be separately attached to the perimeter wall of the second compartment in any appropriate manner (e.g., via adhesive), one or more flaps or tabs could be integrally formed with or separately attached to the cover, or both. Each such flap or tab may be formed from any appropriate material or combination of materials, and may be of any appropriate size, shape, and/or configuration. In one embodiment, each such flap or tab is formed from or otherwise includes a first material having a melting temperature that is lower than a melting temperature of the container body. As such, after all second transdermal patches have been positioned in the second compartment, the transdermal patch packaging may be heated in any appropriate manner (e.g., in a microwave, provided that no transdermal patches disposed within a foil/metallic primary packaging are currently within the container body) to a temperature which melts the first material, where the melted first material may then come into contact with (e.g., to at least partially encapsulate) the second transdermal patches (e.g., to reduce the potential that these second transdermal patches may be "re-used").

The transdermal patch packaging may include a containment that is disposed within the container body, where the second compartment is located within an interior of this containment. One embodiment has this containment being movable relative to the container body (e.g., such that the containment may be repeatedly positioned in and/or withdrawn from the container body). Another embodiment has this containment being fixed relative to the container body. The various features discussed above in relation to the second compartment may thereby equally applicable to this containment.

A first material may be disposed within the second compartment. This first material may have a first melting temperature that is less than a second melting temperature of the container body. Heating the transdermal patch packaging to at least the first melting temperature, but not to the second melting temperature, should cause the first material to transition to a different state (e.g., from a solid to a liquid or at least a "flowable" state) so as to come into contact with the various second transdermal patches within the second compartment. In one embodiment, the first material, after first being heated in the noted manner and thereafter allowed to cool to a suitable temperature, may at least partially encapsulate each of the second transdermal patches within the second compartment.

A second aspect of the present invention is generally directed to a transdermal patch containment that includes a perimeter wall, a base, and an end wall that collectively define an internal compartment. The base and end wall are oppositely disposed, and the end wall includes a plurality of slots. At least one transdermal patch is contained within the internal compartment.

A number of feature refinements and additional features are applicable to the second aspect of the present invention. These feature refinements and additional features may be used individually or in any combination. As such, each of the following features that will be discussed may be, but are not required to be, used with any other feature or combination of features of the second aspect of the present invention.

Each of the features addressed above in relation to the noted containment that may be utilized by the first aspect are equally applicable to the transdermal patch containment of the second aspect. Each of the features discussed above in relation to the second compartment utilized by the first aspect are equally applicable to the internal compartment utilized by the second aspect. For instance, the transdermal patch containment of this second aspect may contain one or more flaps or tabs in accordance with the discussion presented above with regard to the first aspect. The discussion presented above on the cover apertures that may be used by the first aspect is also equally applicable to the slots on the end wall for the case of this second aspect. The first material addressed above in relation to the first aspect may also be incorporated into the transdermal patch containment of this second aspect.

A third aspect of the present invention is generally directed to a method for dosing pharmaceutical product that includes removing a transdermal patch from a first compartment of a container, thereafter delivering a pharmaceutical product from the transdermal patch, and thereafter positioning the transdermal patch in a second compartment of the container.

A number of feature refinements and additional features are applicable to the third aspect of the present invention. These feature refinements and additional features may be used individually or in any combination. As such, each of the following features that will be discussed may be, but are not required to be, used with any other feature or combination of features of the third aspect of the present invention.

Any of the above discussed containers or containments may be utilized as part of the pharmaceutical product dosing method of the third aspect. For instance, the container of the first aspect may be used, which may or may not have the containment of the second aspect disposed in the second compartment of the container. In any event, the delivery of pharmaceutical product may include applying the transdermal patch to skin (e.g., which may include transdermally delivering the pharmaceutical product from the transdermal patch to the skin).

The method of the third aspect may also include one or more steps designed to further inhibit and/or limit access to and/or use of the transdermal patch. In one arrangement, the method may include adhering the transdermal patch to a substrate prior to the positioning the same into the second compartment of the container. For instance, the substrate may include a plurality of transdermal patch receiving zones, each of which includes adhesive. In another arrangement, the method may include wrapping the transdermal patch in a disposal member prior to positioning the same into the second compartment of the container. For example, the disposal member may include a sheet which in turn comprises adhesive. In an even further arrangement, the method may include heating the container to at least a melting temperature of a heat-activated component (e.g., a layer disposed within said second compartment), that is associated with the container, after the transdermal patch has been positioned within the second compartment, and encapsulating the transdermal patch in the heat-activated component in response to the noted heating.

The method of the third aspect may be repeated any appropriate number of times in relation to a number of different transdermal patches. Any appropriate number of transdermal patches may be initially contained in the first compartment. Any appropriate number of transdermal patches may be positioned within the second compartment. After at least one transdermal patch has been positioned within the second compartment of the container, the method may further include disposing of the container in any appropriate manner.

Each transdermal patch utilized with the present invention may include any appropriate pharmaceutical product. Examples of appropriate pharmaceutical products that may be included in such transdermal patches include (but are not limited to): U.S. Drug Enforcement Administration (DEA) scheduled (e.g., Schedule II) drugs such as fentanyl, lidocaine, tetracaine, prilocaine, thebaine, buprenorphine, sufentanil, alfentanil, codeine, dihydrocodeine, hydrocodone, hydromorphone, levorphanol, methadone, morphine, nalbuphine, noscapine, opium, oxycodone, and propoxyphene; non-steroidal anti-inflammatory drugs (NSAIDs) such as ketoprofen, diclofenac, flurbiprofen, and ibuprofen; steroids such as testosterone and estradiol; psychoactive drugs such as buspirone; vitamins such as vitamin B12; vasodilators such as nitroglycerin; vaccines; antiemetics; capsaicin; and nicotine. Further, any transdermal patches utilized with the present invention can function to provide drug delivery in any appropriate manner. For instance, such transdermal patches may include those functioning via a passive delivery mechanism (e.g., pharmaceutical product located within the adhesive of the patch, within a reservoir of the patch, within a semisolid matrix (e.g., a gel)) or via an active delivery mechanism (e.g., iontophoresis, sonophoresis, electroporation, microneedles, abrasion, needle-less injection, suction, stretching, magnetophoresis, radio frequency, lasers, photomechanical waves, temperature (e.g., heat-activation)).

Any feature of any other various aspects of the present invention that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that a compartment includes "a transdermal patch" alone does not mean that the compartment includes only a single transdermal patch). Moreover, any failure to use phrases such as "at least one" also does not limit the corresponding feature to the singular (e.g., indicating that a compartment includes "a transdermal patch" alone does not mean that the compartment includes only a single transdermal patch). Use of the phrase "at least generally" or the like in relation to a particular feature encompasses the corresponding characteristic and insubstantial variations thereof (e.g., indicating that a container body is at least generally rectangular encompasses the container body being rectangular). Finally, a reference of a feature in conjunction with the phrase "in one embodiment" does not limit the use of the feature to a single embodiment.

DETAILED DESCRIPTION

Figure 1:
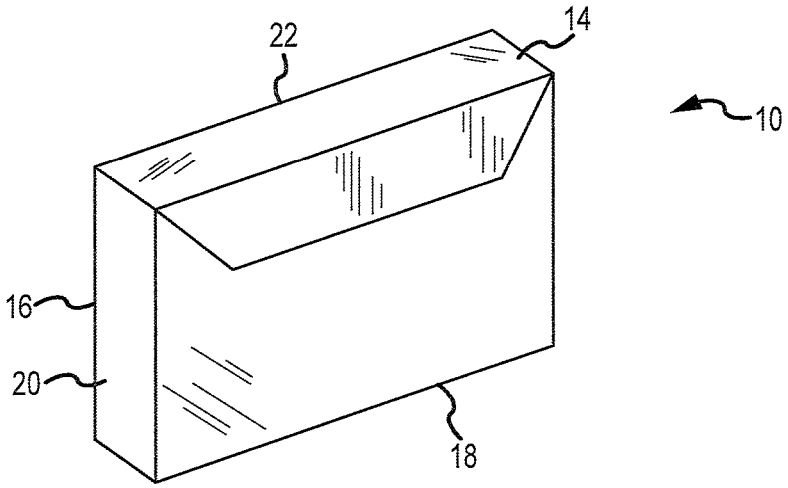
FIG. 1 is a perspective view of one embodiment of transdermal patch packaging.
Figure 2:
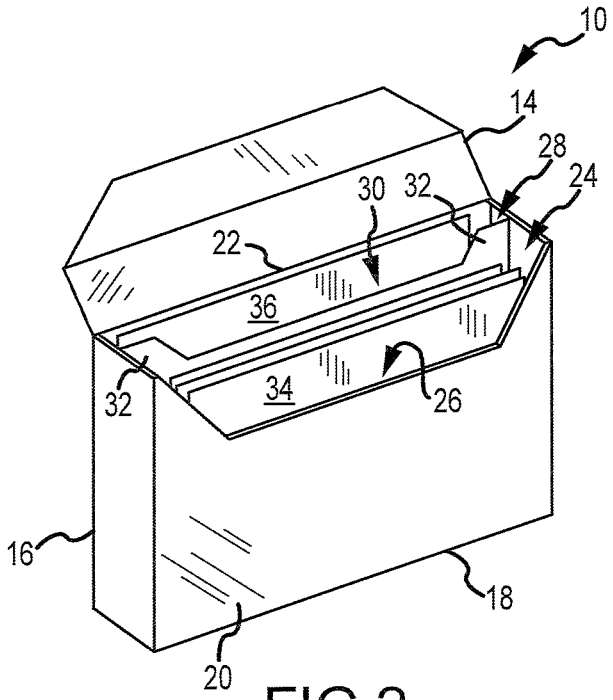
FIG. 2 is a perspective view of the transdermal patch packaging of FIG. 1, with an open lid to illustrate its multiple internal storage compartments for transdermal patches.

FIGS. 1 and 2 illustrate one embodiment of a transdermal patch container or transdermal patch packaging 10. The transdermal patch container 10 includes a container body 16 and a lid 14. The lid 14 is movable relative to the container body 16 by a hinge 22 of any appropriate type (e.g., a fold line between the lid 14 and container body 16). Generally, the lid 14 may be disposed in the closed position of FIG. 1, and may be moved relative to the container body 16 to the open position shown in FIG. 2 to provide access to the interior of the transdermal patch container 10. Other types of lids could be used by the transdermal patch container 10, for instance lids that are totally removable from the container body 16 (e.g., via a detachable interconnection (e.g., snap lock, threads) such that the lid could be attached, removed, and reattached to the container body 16 without damaging either the lid and/or container body 16).

The container body 16 includes a base 18 and a container body sidewall or perimeter wall 20. The base 18 is disposed opposite of the above-noted lid 14. Disposing the base 18 on an appropriate supporting surface in turn disposes the transdermal patch container 10 in an upright position. The lid 14 and container body 16 may be of any appropriate size, shape, and/or configuration. In one embodiment, the lid 14 and container body 16 are integrally formed (e.g., a unitary structure without any joint(s) between the lid 14 and container body 16). The lid 14 and container body 16 each may be formed from any appropriate material or combination of materials. For instance, the lid 14 and container 16 may be formed from cardboard, paperboard, plastic, or the like.

The transdermal patch container 10 includes a plurality of separate storage areas. FIG. 2 shows the lid 14 in an open position that exposes a first compartment 24 and a second compartment 28. A divider 32 separates the first compartment 24 from the second compartment 28, for instance by extending between opposing portions of the container body sidewall 20. As such, the first compartment 24 is defined by a first portion of the container body sidewall 20 and the divider 32, while the second compartment 28 is defined by a second portion of the container body sidewall 20 and the divider 32.

Access to each of the first compartment 24 and the second compartment 28 is controlled by the lid 14 of the transdermal patch container 10. Disposing the lid 14 in its open position (e.g., FIG. 2) exposes a first opening 26 that provides access to an entirety of the first compartment 24. Disposing the lid 14 in its open position (e.g., FIG. 2) also simultaneously exposes a second opening 30 that provides access to an entirety of the second compartment 28.

One or more first transdermal patches 34 may be stored in the first compartment 24, while one or more second transdermal patches 36 may be simultaneously stored in the second compartment 28. The divider 32 at least somewhat isolates (e.g., physically) the first compartment 24 from the second compartment 28. Therefore, the first transdermal patches 34 should in turn be physically isolated from the second transdermal patches 36. The first compartment 24 may be sized to accommodate any appropriate number of first transdermal patches 34. Similarly, the second compartment 28 may be sized to accommodate any appropriate number of second transdermal patches 36.

Figure 2A:
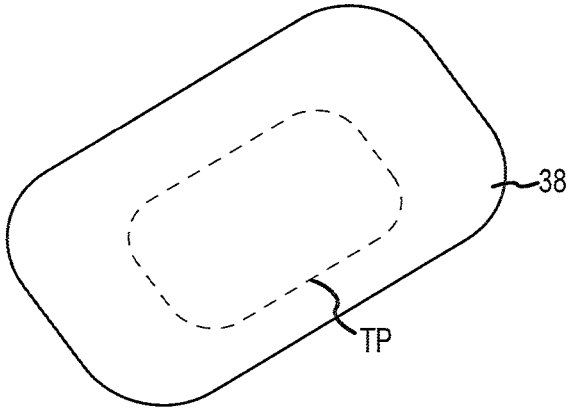
FIG. 2A is a schematic of a transdermal patch within primary packaging.

The first transdermal patches 34 may be individually contained within appropriate primary packaging (e.g., within a sealed pouch, jacket, foil wrapping, or the like). FIG. 2A shows a transdermal patch TP within representative primary packaging 38 of this type. The transdermal patch TP may be of any appropriate shape and of any appropriate configuration. The transdermal patch TP may include any appropriate pharmaceutical product. Examples of appropriate pharmaceutical products that may be included in such transdermal patches include (but are not limited to): U.S. Drug Enforcement Administration (DEA) scheduled (e.g., Schedule II) drugs such as fentanyl, lidocaine, tetracaine, prilocaine, thebaine, buprenorphine, sufentanil, alfentanil, codeine, dihydrocodeine, hydrocodone, hydromorphone, levorphanol, methadone, morphine, nalbuphine, noscapine, opium, oxycodone, and propoxyphene; non-steroidal anti-inflammatory drugs (NSAIDs) such as ketoprofen, diclofenac, flurbiprofen, and ibuprofen; steroids such as testosterone and estradiol; psychoactive drugs such as buspirone; vitamins such as vitamin B12; vasodilators such as nitroglycerin; vaccines; antiemetics; capsaicin; and nicotine. Further, the transdermal patch TP can function to provide drug delivery in any appropriate manner. For instance, the transdermal patch TP may include those functioning via a passive delivery mechanism (e.g., pharmaceutical product located within the adhesive of the patch, within a reservoir of the patch, within a semisolid matrix (e.g., a gel)) or via an active delivery mechanism (e.g., iontophoresis, sonophoresis, electroporation, microneedles, abrasion, needle-less injection, suction, stretching, magnetophoresis, radio frequency, lasers, photomechanical waves, temperature (e.g., heat-activation)).

The first transdermal patches 34 may differ from the second transdermal patches 36 in one or more respects. The first transdermal patches 34 may be characterized as being new or unused (e.g., not yet having been mounted on or adhered to a patient), while the second transdermal patches 36 may be characterized as having been used by a patient (e.g., having been mounted on or adhered to a patient). The first transdermal patches 34 may be individually contained within appropriate primary packaging, while the second transdermal patches 36 may be in an exposed state or where the individual second transdermal patches 36 have been removed from their associated primary packaging before being disposed within the second compartment 28. Each of the "exposed" second transdermal patches 36 may either have been used by a patient (e.g., having been mounted on or adhered to a patient such that pharmaceutical product was delivered to the patient) or not (e.g., the second compartment 28 may contain one or more transdermal patches that were removed from their associated primary packaging and disposed in the second compartment 28 before being used by a patient). The first transdermal patches 34 may include a first amount of pharmaceutical product (e.g., a prescribed dose), while the second transdermal patches 36 may include a second amount of pharmaceutical product (e.g., something less than the prescribed dose, for instance based upon the transdermal patch having been mounted on or adhered to a patient for a period of time such that at least part of its pharmaceutical product was delivered to the patient), where the first and second amounts are different.

In one embodiment, the transdermal patch container 10 is prescribed to a patient with a predetermined number of first transdermal patches 34 within the first compartment 24. As the patient goes through the prescription, the patient may dispose of the second transdermal patches 36 by placing the same in the second compartment 28. Once the patient has used the entire prescription, all of the first transdermal patches 34 that were originally provided should now be within the second compartment 28 in the form of second transdermal patches 36 (e.g., there would no longer be any first transdermal patches 34 within the first compartment 24 in this instance).

Figure 3:
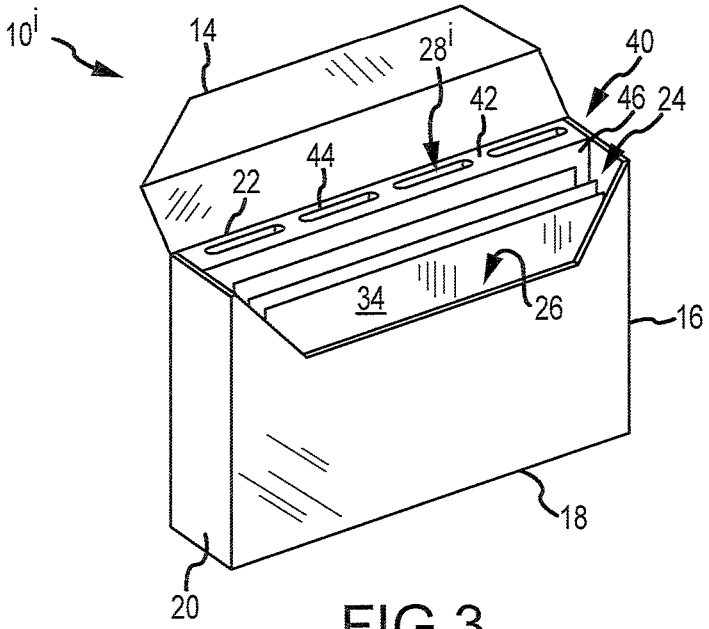
FIG. 3 is a perspective view of another embodiment of transdermal patch packaging with multiple internal storage compartments for transdermal patches.

A variation of the transdermal patch container 10 of FIGS. 1-2 is presented in FIG. 3 and is identified by reference numeral 10$^{i}$. Corresponding components between the embodiments of FIG. 3 and FIGS. 1-2 are identified by a common reference numeral. Those corresponding components that differ in at least some respect are identified by a superscripted "i" designation in FIG. 3.

The transdermal patch container 10$^{i}$, includes a containment 40 having an enclosed second compartment 28$^{i}$ for storage of second transdermal patches 36. This containment 40 could be removably disposed within the container body 16 of the transdermal patch container 10$^{i}$, (e.g. such that the containment 40 could be removed from and inserted into the container body 16; in the form of an autonomous structure). Alternatively, the containment 40 could be fixed relative to the container body 16 in any appropriate manner (e.g., via one or more adhesives). The containment 40 could also be defined simply by positioning an upper end wall or cover 42 over the second opening 30 shown in FIG. 2.

The containment 40 includes an upper end wall or cover 42 that is disposed opposite of the base 18 of the container body 16. The containment 40 also includes a perimeter wall 46 that extends a full 360° about the perimeter of the second compartment 28$^{i}$. The perimeter wall 46 could be defined by one or more of the above-noted divider 32 and the above-noted second portion of the container body sidewall 20. The perimeter wall 46 could also be a completely separate structure from each of the divider 32 and the above-noted second portion of the container body sidewall 20. In one embodiment, the divider 32 shown in the embodiment of FIGS. 1-2 could be integrally formed with the upper end wall 42 shown in FIG. 3 and could be used to define an enclosed space for the containment 40 (along with the above-noted second portion of the container body sidewall 20).

The noted upper end wall 42 includes one or more apertures or slots 44 to provide access to the enclosed second compartment 28$^{i}$ of the containment 40. Each such slot 44 may be defined in any appropriate manner, and furthermore may be of any appropriate size, shape, and/or configuration. Any appropriate number of slots 44 may be utilized. Multiple slots 44 may be disposed in any appropriate arrangement. In one embodiment, the slots 44 are in the form of pre-existing structures. In another embodiment, the slots 44 may be defined by a user perforating the containment upper end wall 42 along a predetermined path (e.g., along a scored segment). This may also be utilized to provide an indication of how many second transdermal patches 36 have been disposed in the second compartment 28$^{i}$(e.g., instructions may be provided for users to only insert one second transdermal patch 36 through any one slot 44). Each of the slots 44 could also include any appropriate labeling (e.g., "used patch #1", "used patch #2", etc, or the like).

Figure 4A:
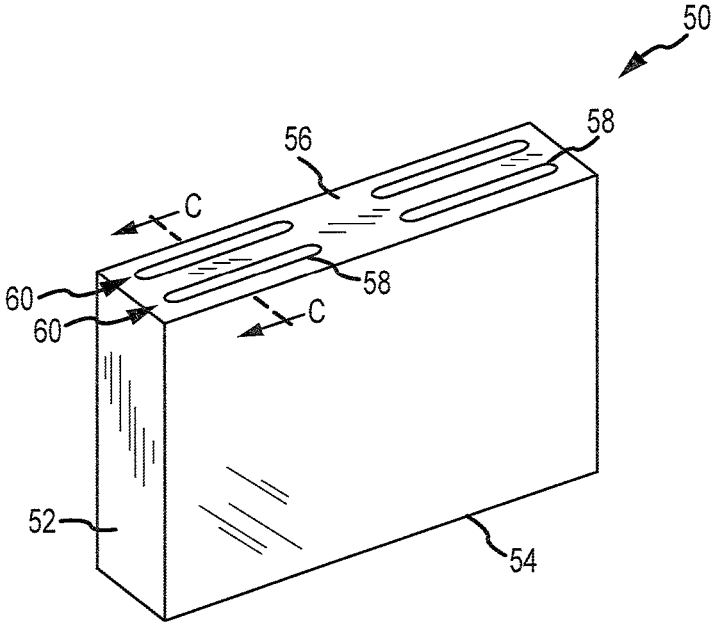
FIG. 4A is a perspective view of one embodiment of a separate containment for transdermal patches.
Figure 4B:
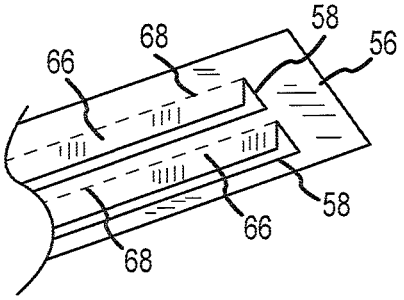
FIG. 4B is a perspective view of a portion of two of the slots used by the containment of FIG. 4A to access an interior compartment in which transdermal patches may be disposed, and further illustrating a corresponding flap that may be utilized.
Figure 4C:
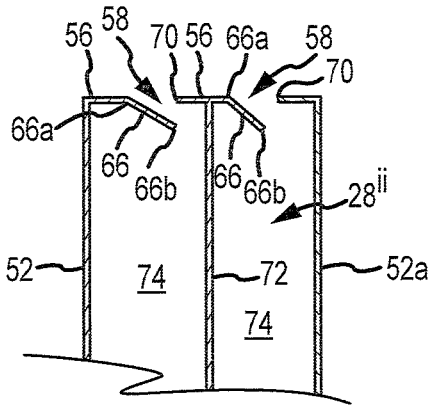
FIG. 4C is a cross-sectional view of the containment of FIG. 4A taken along line C-C.

One embodiment of a separate containment for second transdermal patches 36 is illustrated in FIGS. 4A-C and is identified by reference numeral 50. Generally, the containment 50 could be positioned within the second compartment 28 of the transdermal patch container 10 of FIGS. 1-2. Another option would be for the transdermal patch container 10 of FIGS. 1-2 to eliminate the above-described divider 32, and to instead use the containment 50 of FIGS. 4A-C to provide physical separation between any second transdermal patches 36 in the containment 50 and the first transdermal patches 34 in the first compartment 24 of the transdermal patch container 10. The transdermal patch container 10 of FIGS. 1-2 could incorporate the containment 50 in any appropriate manner to define a compartment that is separate from its first compartment 26.

The containment 50 of FIG. 4A includes a perimeter wall 52, a base 54 (e.g., a portion of the container body base 18), and an upper end wall 56. When the containment base 54 is disposed on an appropriate supporting surface, the containment 50 is disposed in an upright orientation. Like the containment 40 of FIG. 3, the upper end wall 56 includes one or more apertures or slots 58. A single row of slots 44 is shown for the FIG. 3 embodiment, while two rows 60 of slots 58 are shown for the embodiment of FIGS. 4A-C. Each of the containments 40, 50 may utilize any appropriate number of slot rows, and any appropriate number of slots may provided for each slot row. The discussion presented above with regard to the slots 44 used by the embodiment of FIG. 3 is equally applicable to the slots 58 used by the embodiment of FIG. 4A, unless otherwise specifically noted to the contrary.

Generally, the perimeter wall 52, base 54, and upper end wall 56 collectively define an enclosed space in the form of a second compartment 28$^{ii}$ for receiving second transdermal patches 36. FIG. 4C illustrates that the second compartment 28$^{ii}$ is actually subdivided into two separate sub-compartments 74 by an internal divider 72. The second compartment 28$^{ii}$ could be divided up into any appropriate number of sub-compartments 74 and in any appropriate manner. The second compartment 28$^{ii}$ could also be in the form of a single continuous space (e.g., each slot 58 could access the same common interior space—not shown).

FIGS. 4B and 4C illustrate that the containment 50 utilizes a separate flap or tab 66 in conjunction with each slot 58 (e.g., each slot 58 may have its own dedicated flap 66). Such flaps or tabs 66 could be used by the embodiment of FIG. 3 as well. In any case, a flap 66 may be utilized to reduce the potential of a second transdermal patch 36 being withdrawn out of the second compartment 28$^{ii}$ (or any other internal compartment disclosed herein) through its corresponding slot 58. In the illustrated embodiment, the various flaps 66 are integrally formed with the upper end wall 56. For instance and as discussed above in relation to the FIG. 3 embodiment, the slots 58 may be defined by a user perforating the upper end wall 56 along a predetermined path (e.g., along a scored segment 70—where a flap 66 separates from a remainder of the upper end wall 56). The part of each flap 66 that remains attached or connected to the containment upper end wall 56 may include a hinge 68 (e.g., a fold or fold line) about which the flap 66 may move. A flap 66 could also be separately attached to the containment upper end wall 56 and/or perimeter wall 52 (not shown). In any case, each flap 66 may be characterized as a cantilever—having a fixed end 66*a* (where it extends from the upper end wall 56) and an oppositely disposed free end 66*b*. A flap 66 could be associated with more than one slot 58 in a given slot row 60.

FIG. 4C illustrates that each flap 66 is disposed at an acute angle relative to horizontal when the containment 50 is in an upright position, and furthermore extends from the upper end wall 56 both at least generally in the direction of the containment base 54 (e.g., extending in a downward proceeding away from the upper end wall 56 and toward its free end 66*b* when the containment 50 is in an upright position) and at least generally in the direction of a common perimeter wall section 52*a* (e.g., the flaps 66 may be disposed in an at least generally common orientation, and including being disposed in parallel relation). Each flap 66 may be characterized as being positioned at least partially below its corresponding slot 58. As such, directing a second transdermal patch 36 into a slot 58 may deflect the corresponding flap 66 in a downward direction (e.g., by moving its free end 66*b* at least generally in the direction of the base 54 and at least generally about its corresponding hinge 68). If the second transdermal patch 36 is directed completely past this flap 66, the flap 66 could move at least partially back toward its original position, which should reduce the potential that a second transdermal patch 36 could be withdrawn back out of the second compartment $\mathbf{28}^{ii}$ through its corresponding slot 58. Even if a second transdermal patch 36 is not directed completely past the flap 66, pulling back up on such second transdermal patch 36 may cause the free end 66*b* of the corresponding flap 66 to move at least generally upwardly in the direction of the upper end wall 56 and at least generally about its corresponding hinge 68, and which may restrain this upwardly-directed movement of the second transdermal patch 36.

Figure 5:
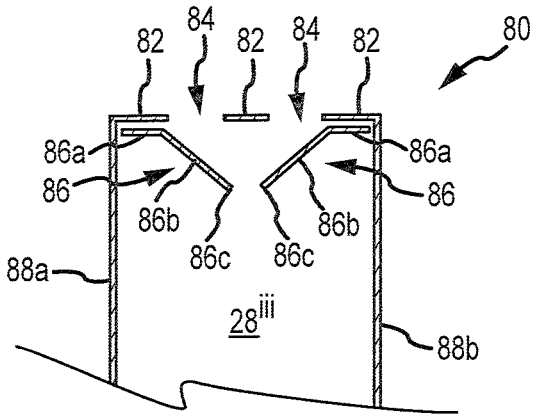
FIG. 5 is a cross-sectional view of another embodiment of a containment with slots for accessing an internal compartment for storage of transdermal patches, and that have a corresponding flap.

Another embodiment of a containment for second transdermal patches 36 is illustrated in FIG. 5 and is identified by reference numeral 80. Generally, the containment 80 could be an autonomous structure and positioned within the second compartment 28 of the transdermal patch container 10 of FIGS. 1-2. Another option would be for the transdermal patch container 10 of FIGS. 1-2 to eliminate the above-described divider 32, and to instead use the containment 80 to provide physical separation between any second transdermal patches 36 in the containment 80 and any first transdermal patches 34 in the first compartment 24 of the transdermal patch container 10. Yet another option would be for the containment 80 of FIG. 5 to be used in place of the containment 40 of FIG. 3 as described above. The transdermal patch container 10 of FIGS. 1-2 could incorporate the containment 80 in any appropriate manner to define a compartment that is separate from its first compartment 26.

The containment 80 of FIG. 5 includes a perimeter wall that includes a first perimeter wall section 88*a* and a second perimeter wall section 88*b*, a base (not shown), and an oppositely disposed upper end wall 82. When the base of the containment 80 is disposed on an appropriate supporting surface, the containment 80 will be disposed in an upright orientation. Like the containment 50 of FIGS. 4A-C, the upper end wall 82 of the containment 80 includes a plurality of apertures or slots 84. More specifically, the containment 80 includes two rows of slots 84 (e.g., similar to the rows 60 shown in FIG. 4A), with each such row having any appropriate number of slots 84. The discussion presented above with regard to the slots 44 used by the embodiment of FIG. 3 again is equally applicable to the slots 84 used by the embodiment of FIG. 5.

Generally, the perimeter wall, base, and upper end wall 82 of the containment 80 collectively define an enclosed space in the form of a second compartment $\mathbf{28}^{iii}$ for receiving second transdermal patches 36. The second compartment $\mathbf{28}^{iii}$ is in the form of a single continuous space in the illustrated embodiment (e.g., each of the slots 84 accesses the same, common interior space). The second compartment $\mathbf{28}^{iii}$ could also be subdivided into multiple sub-compartments in the manner discussed above in relation to the embodiment of FIGS. 4A-C, where two or more adjacent rows of slots 84 would each access a common sub-compartment (not shown).

FIG. 5 illustrates that the containment 80 may utilize a separate flap or tab 86 in conjunction with each slot 84 (e.g., each slot 84 may have its own dedicated flap 86). A flap 86 could be associated with more than one slot 84 where multiple slots are disposed in a common row (e.g., where the length dimension of multiple slots 84 are disposed along a common line). In any case, each flap 86 could be incorporated by the containment 80 in the manner discussed above with regard to the containment 50 of FIGS. 4A-C (e.g., where the various flaps 86 could be characterized as being integrally formed with the upper end wall 82). However and in the illustrated embodiment of FIG. 5, each flap 86 is actually a separate structure from the upper end wall 82, and includes a first flap section 86*a* that is appropriately secured to the underside of the upper end wall 82 (e.g., via an adhesive), as well as a second flap section 86*b* that extends at least generally in the direction of the base 54 (e.g., extends downwardly from the upper end wall 82 when the containment 80 is in an upright position) and at least generally in the direction of the second flap section 86*b* of an adjacent flap 86. The orientation of the flap(s) 86 in one row of slots 84 may be at least generally the mirror image of the flap(s) 86 in an adjacent row of slots 84. The flap(s) 86 in one row of slots 84 and the flap(s) 86 in an adjacent row of slots 84 may also be characterized as at least generally converging toward each other progressing in the direction of their respective free ends 86*c*. Yet another characterization is that the containment 80 includes at least one pair of adjacently disposed slots 84, where the flap 86 for one slot 84 of this pair extends at least generally in the direction of the base and also least generally in the direction of the above-noted second perimeter wall section 88*b*, and where the flap 86 for the other slot 84 of this pair extends at least generally in the direction of the base and also least generally in the direction of the above-noted first perimeter wall section 88*a*.

As in the case of the embodiment of FIGS. 4A-C, each flap 86 may be characterized as a cantilever—having a fixed end (e.g., its first flap section 86*a*) and an oppositely disposed free end 86*c*. Each flap 86 may be characterized as being positioned at least partially below its corresponding slot 84. The flaps 86 of the containment 80 of FIG. 5 may function in the manner discussed above with regard to the flaps 66 of the containment 50 of FIGS. 4A-C with regard to at least reducing the potential that second transdermal patches 36 can be removed from the second compartment $\mathbf{28}^{iii}$ through one or more of the slots 84.

Figure 6:
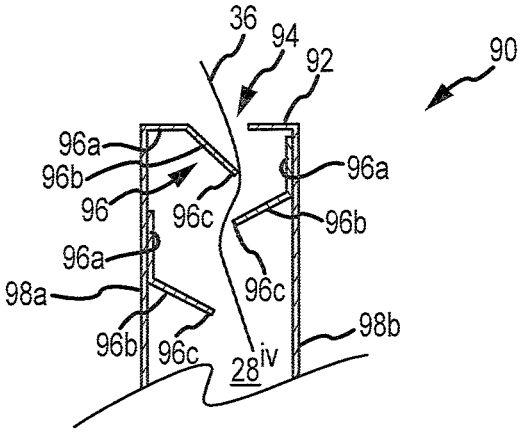
FIG. 6 is a cross-sectional view of another embodiment of a containment with slots for accessing an internal compartment for storage of transdermal patches, and which incorporates a plurality of vertically-spaced flaps.

Another embodiment of a containment for second transdermal patches 36 is illustrated in FIG. 6 and is identified by reference numeral 90. Generally, the containment 90 could be an autonomous structure and positioned within the second compartment 28 of the transdermal patch container 10 of FIGS. 1-2. Another option would be for the transdermal patch container 10 of FIGS. 1-2 to eliminate the above-described divider 32, and to instead use the containment 90 to provide separation between any second transdermal patches 36 in the containment 90 and first transdermal patches 34 in the first compartment 24 of the transdermal patch container 10. Yet another option would be for the containment 90 of FIG. 6 to be used in place of the containment 40 of FIG. 3 as described above. The transdermal patch container 10 of FIGS. 1-2 could incorporate the containment 90 in any appropriate manner to define a compartment that is separate from its first compartment 26.

The containment 90 of FIG. 6 includes a perimeter wall having a first perimeter wall section 98*a* and a second perimeter wall section 98*b*, a base (not shown; e.g., part of the container body base 18), and an oppositely disposed upper end wall 92. When its base is disposed on an appropriate supporting surface, the containment 90 is disposed in an upright orientation. In any case, the upper end wall 92 includes one or more slots or apertures 94. The discussion presented above with regard to the slots 44 used by the embodiment of FIG. 3 is equally applicable to the slots 94 used by the embodiment of FIG. 6.

Generally, the perimeter wall, base, and upper end wall 92 of the containment 90 collectively define an enclosed space in the form of a second compartment 28$^{iv}$ for receiving second transdermal patches 36. The second compartment 28$^{iv}$ is in the form of a single continuous space in the illustrated embodiment. The second compartment 28$^{iv}$ could also be subdivided into multiple sub-compartments in the manner discussed above in relation to the embodiment of FIGS. 4A-C.

FIG. 6 illustrates that the containment 90 may utilize a plurality of flaps or tabs 96 that are disposed in vertically spaced or staggered relation when the containment 90 is in the illustrated upright position or orientation. In one embodiment, the length dimension of each of the flaps 96 shown in FIG. 6 coincides with the length of at least one slot 96 (e.g., each slot 96 could have its own flap 96). In the case where there are a plurality of slots 94 disposed in spaced relation and in a common row, each of the flaps 96 shown in FIG. 6 could extend along the entire length or any portion of the length of such a row (e.g., a flap 96 could be associated with one or more slots 96 in the same row).

The uppermost flap 96 shown in FIG. 6 is positioned at least partially below at least one slot 94, and may be incorporated by the containment 90 in any appropriate manner. In the illustrated embodiment, the uppermost flap 96 includes a first flap section 96*a* that is appropriately attached to an underside of the upper end wall 92. A second flap section 96*b* of this uppermost flap 96 extends downwardly and also toward the above-noted second perimeter wall section 98*b* of the containment 90. The next flap 96 (proceeding downwardly in the vertical dimension when the containment 90 is upright) has its first flap section 96*a* appropriately attached to the second perimeter wall section 98*b* of the containment sidewall 98, and its corresponding second flap section 96*b* extends downwardly and toward the oppositely disposed first perimeter wall section 98*a* of the containment 90. The next flap 96 (again proceeding downwardly in the vertical dimension when the containment 90 is upright) has its first flap section 96*a* appropriately attached to the first perimeter wall section 98*a* of the containment 90, and its corresponding second flap section 96*b* extends downwardly and also toward the oppositely disposed second perimeter wall section 98*b* of the containment 90.

The flaps 96 that extend toward a common perimeter wall section (e.g., the second perimeter wall section 98*b* shown in FIG. 6) may be disposed in at least generally parallel relation. However, such may not be the case after a second transdermal patch 36 has been directed into a corresponding slot 94. In this regard, any appropriate number of flaps 96 could be vertically spaced or staggered within the second compartment 28$^{iv}$ of the containment 90. Generally, these vertically spaced or staggered flaps 96 may provide a tortuous path within the second compartment 28$^{iv}$, which may affect the ability to withdraw second transdermal patches 36 out of the second compartment 28$^{iv}$ through a slot 94.

Figure 7A:
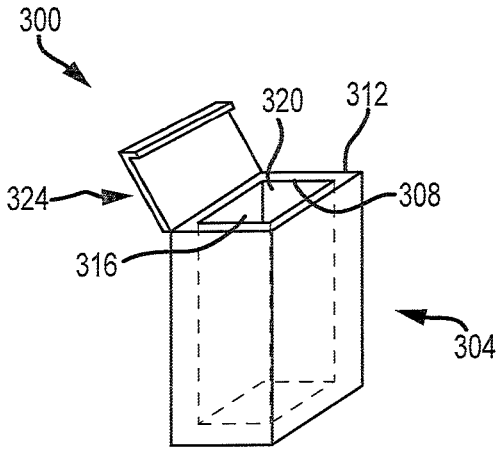
FIG. 7A is a perspective view of a transdermal patch containment with a heat-activated encapsulating material.

FIG. 7A presents a perspective view of one embodiment of a transdermal patch containment 300 (e.g., case) that includes an encapsulating material of any appropriate type and/or configuration. The containment 300 may include a container body in the form of a shell 304 including inside and outside surfaces 308, 312, in addition to a chamber 316 situated within the shell 304 for holding or containing one or more pharmaceutical products such as one or more new or used transdermal patches TP (e.g., FIGS. 7B and 7C). The inside surface 308 may generally face towards the chamber 316 and the outside surface 312 may generally face away from the containment 300. Access to the chamber 316 may be provided via an access in the form of an opening 320. The containment 300 may also include an access member in the form of a cover 324 (e.g., lid, top) for selectively sealing or closing off the chamber 316 (or otherwise selectively limiting and/or allowing access to the opening 320) and may be interconnected to the shell 304 in any appropriate manner (e.g., pivotally). Although not labeled, the shell 304 and cover 324 may respectively include corresponding locking members to selectively removably attach the cover 324 to the shell 304 and seal or otherwise limit access to the chamber 316.

Figure 7B:
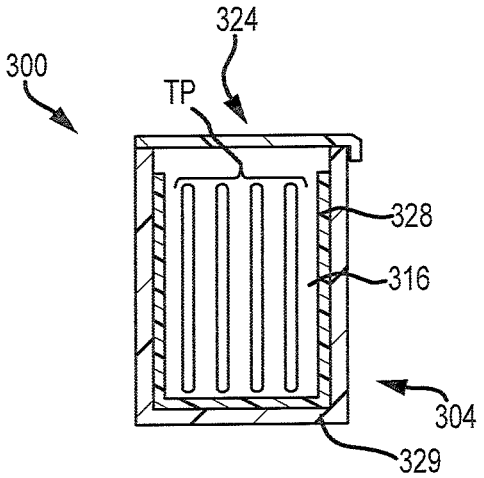
FIG. 7B is a cross-sectional view of the containment of FIG. 7A before being heated to a melting temperature of the encapsulating material.

Turning now to FIG. 7B, a cross-sectional view of the containment 300 is shown, and illustrates a number of transdermal patches TP being received within the chamber 316. As shown, a heat-activated encapsulation component 328 in the form of a sleeve may be appropriately disposed within the chamber 316. Generally, heating the entire containment 300 to at least a melting temperature of the encapsulation component 328, but to a temperature that is less than a melting temperature of the shell 304 and cover 324, will cause the encapsulation component 328 to melt or transition to a different phase (e.g., change from a solid state to a liquid or liquid-like state (e.g., become more flowable)). The encapsulation component 328 in this modified state should come into contact with at least some and more preferably all of the transdermal patches TP contained within the chamber 316. As the containment 300 is allowed to cool, the encapsulation component 328 should again transition to a different phase (e.g., from liquid or liquid-like/flowable state back to a more solidified state). At this time, at least some, and including each of the transdermal patches TP, may be at least partially encapsulated in the encapsulation component 328. Any appropriate material may be used as the encapsulation component 328, including without limitation plastic, wax, adhesive, and all combinations thereof, The encapsulation component 328 may extend substantially from one side (not labeled) of the chamber 316 to an opposite side (not labeled) of the chamber 316. In other words, the encapsulation component 328 may be sized to have a diameter that is approximately equal to a diameter of the chamber 316 such that the transdermal patches TP may be inserted into or otherwise disposed within the encapsulation component 328. As also shown, the encapsulation component 328 may extend across a bottom surface 329 of the shell 304. Although not illustrated in FIG. 7B, the encapsulation component 328 may also extend from one end (not labeled) of the chamber 316 to an opposite end (not labeled) of the chamber 316 (e.g., the encapsulation component 328 may line at least substantially an entirety of a perimeter of the chamber 316). In this regard, the encapsulation component 328 may be designed to cover or be otherwise be disposed over at least a portion of most or all of the inside surface 308 (e.g., two sides and two ends) of the shell 304. The encapsulation component 328 may be removably disposed in the chamber 316 or may be appropriately attached to the inside surface 308 of the shell 304 (e.g., via adhesives, as part of the manufacturing process of the containment 300).

Figure 7C:
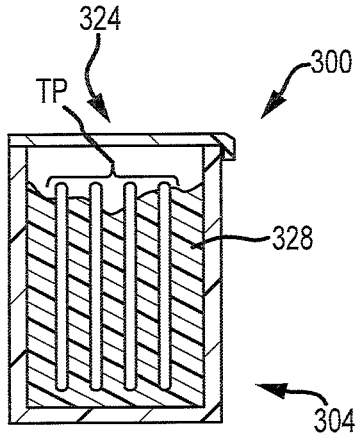
FIG. 7C is a cross-sectional view of the containment of FIG. 7A after being heated to at least the melting temperature of the encapsulating material.

FIG. 7C is a cross-sectional view of the containment 300 after the cover 324 has been secured to the shell 304 of the containment 300, and after the containment 300 has been heated to at least a melting temperature of the encapsulation component 328 (but less than a melting temperature of the shell 304 and cover 324), and thereafter been allowed to cool for a predetermined period of time. As can be seen, the encapsulation component 328 has melted and thereafter solidified around at least a portion of the transdermal patches TP (e.g., "sandwiched" around) so as to at least partially encapsulate or encase the transdermal patches TP. This should reduce the potential of any further use of the transdermal patches TP. The containment 300 may at this point be appropriately disposed of (e.g., deposited in a trash receptacle) to further reduce the chance of illicit usage of the transdermal patches TP within the containment 300. Although not shown, one or more encapsulation components 328 may be appropriately disposed on an inside surface (not labeled) of the cover 324 which may melt and flow onto the transdermal patches TP and/or locking members or other structures to, after solidifying, further render the transdermal patches TP at least partially unusable and/or non-removably interconnect the cover 324 to the shell 304 to limit access to the chamber 316 and the transdermal patches TP. In some arrangements, the chamber 316 may include one or more ribs or rails attached to the inside surface 308 to define a number of slots, each of which can receive one or more transdermal patches TP or other pharmaceutical products. In this arrangement, one or more encapsulation components 328 may be disposed in each such slot so as to melt around and at least partially encapsulate a transdermal patch TP when the containment 300 has been heated to at least the second melting point.

The embodiments of FIGS. 1-2, 3, 4A-C, 5, and 6 may each utilize an encapsulating material in the manner of the containment 300. Such an encapsulating material may be included in any compartment intended for storing first transdermal patches 34, in any compartment for storing second transdermal patches 36, or both. The flaps discussed above with regard to the embodiments of FIGS. 4A-C, 5, and 6 also may each incorporate an encapsulating material (e.g., a coating; actually forming the flaps from an encapsulating material). Having an encapsulating material within at least part of a compartment for receiving transdermal patches, along with also having one or more flaps that incorporate an encapsulating material, may also be utilized in relation to each of the embodiments of FIGS. 4A-C, 5, and 6. Including a heat-activated adhesive on the flaps discussed above with regard to the embodiments of FIGS. 4A-C, 5, and 6 may also be utilized to facilitate retention of transdermal patches within the associated compartment.

Figure 8:
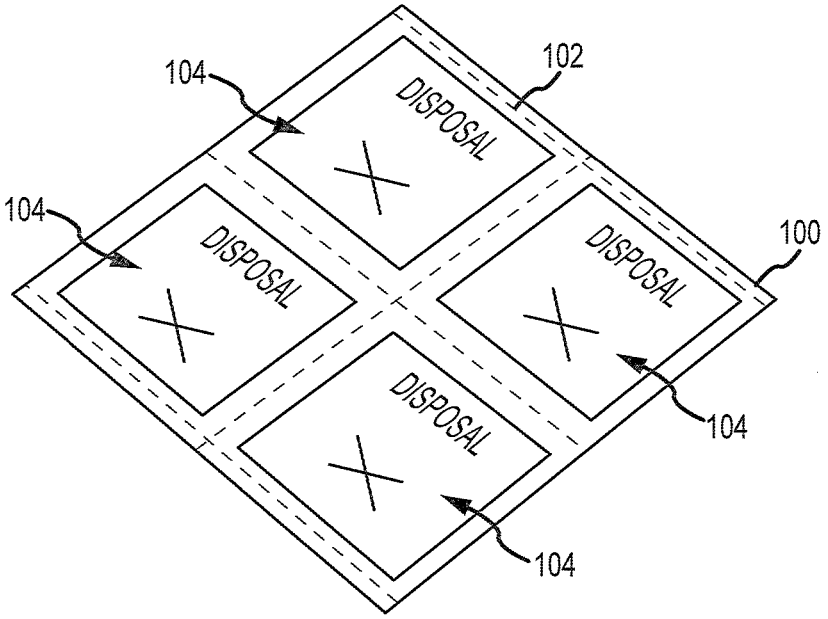
FIG. 8 is an embodiment of a transdermal patch disposal member in the form of a sheet, and that may be used in conjunction with other secondary packaging for the disposal of transdermal patches.

The embodiments of FIGS. 1-6 may be characterized as secondary packaging for transdermal patches (e.g., where "primary packaging" in relation to transdermal patches is typically in the form of a sealed pouch, jacket, or the like). Additional features may be utilized to further facilitate the disposal of transdermal patches. One embodiment of what may be characterized as a transdermal patch ("TP") disposal member is illustrated in FIG. 8 and is identified by reference numeral 100. The TP disposal member 100 generally includes a plurality of predefined regions or zones 104. Each zone 104 accommodates an individual transdermal patch (e.g., a second transdermal patch 36), and each zone 104 may include any appropriate labeling/messaging as desired/required. Preferably a bond exists between the TP disposal member 100 and each transdermal patch positioned thereon (e.g., within a given zone 104). This bond could be provided by remaining adhesive on the transdermal patch, by adhesive on the TP disposal member 100, or both. A new TP disposal member 100 could be stored in secondary packaging that also includes one or more transdermal patches (e.g., first transdermal patches 34), or a new TP disposal member 100 could be provided separately from any such secondary packaging.

The TP disposal member 100 may be in the form of a sheet or substrate formed from any appropriate material or combination of materials, and may be of any appropriate structural configuration. The TP disposal member 100 may also be of any appropriate size, and may include any appropriate number of zones 104. Each zone 104 may include an appropriate adhesive. This adhesive could occupy the entirety of each particular zone 104, or could be disposed in any appropriate arrangement within each particular zone 104 (e.g., disposed about an annular perimeter of each zone 104, such as in the case of the embodiment of FIG. 9 that is discussed below). When an adhesive is used by the TP disposal member 100, it may be desirable to include a release liner or film 102 of any appropriate type. Removal of the liner 102 over a particular zone 104 allows a transdermal patch to be positioned on the TP disposal member 100 within this zone 104. Having the TP disposal member 100 incorporate an adhesive in each zone 104 may further reduce the potential that a transdermal patch could be removed from the TP disposal member 100. However, the remaining adhesive on a transdermal patch could be used to establish a bond with the TP disposal member 100.

The TP disposal member 100 could be disposed within secondary packaging while in the form illustrated in FIG. 8. However, the TP disposal member 100 could be configured such that an individual subsection, that includes a single zone 104, could be removable from a remainder of the TP disposal member 100. These individual subsections could then be disposed within secondary packaging in accordance with the foregoing for disposal purposes. For instance, such individual subsections could be directed into the opening 30 and into the second compartment 28 of the transdermal patch container 10 of FIGS. 1-2, through a slot 44 and into the second compartment $\mathbf{28}^{i}$ of the transdermal patch container $\mathbf{10}^{i}$ of FIG. 3, etc.

Figure 9:
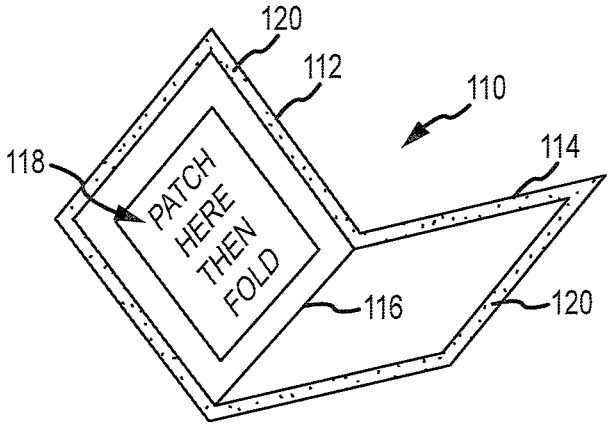
FIG. 9 is an embodiment of a transdermal patch disposal member in the form of a foldable disposal card, and that may be used in conjunction with other secondary packaging for the disposal of one or more transdermal patches.

One embodiment of what may be characterized as an individual transdermal patch disposal card is illustrated in FIG. 9 and is identified by reference numeral 110. One or more disposal cards 110 could be stored in secondary packaging that also includes one or more transdermal patches (e.g., first transdermal patches 34), or one or more disposal cards 110 could be provided separately from any such secondary packaging.

The transdermal patch disposal card 110 may include a first section 112, a second section 114, and a fold line 116 therebetween. The fold line 116 could be pre-existing or predefined, or the fold line 116 could be created by a user folding the disposal card 110 in half after placing a transdermal patch thereon (e.g., a second transdermal patch 36). In the illustrated embodiment, the first section 112 may include labeling/messaging 118 as desired/required. Any appropriate labeling or messaging may be provided on the disposal card 110.

An appropriate adhesive 120 may be included on at least part of at least one of the first section 112 and the second section 114. A release liner or film (not shown) may then be used by the disposal card 110 so as to cover the adhesive 120 until needed for receiving a transdermal patch. The adhesive 120 could occupy the entirety of one or both of the sections 112, 114 (not shown), or could be disposed in any appropriate arrangement on one or both of the sections 112, 114. In the illustrated embodiment, adhesive 120 is disposed only about the perimeter of each of the sections 112, 114. Although remaining adhesive on a transdermal patch could provide a suitable bond between the transdermal patch and the disposal card 110 (e.g., when positioning the adhesive-side of the transdermal patch directly against the disposal card 110), providing adhesive 120 on at least one of the first section 112 and the second section 114 may be utilized to encapsulate a transdermal patch within the disposal card 110 (e.g., when folding the first section 112 relative to the second section 114). This may further enhance the disposal of transdermal patches. Although the transdermal patch disposal card 110 is illustrated as accommodating only a single transdermal patch, it may be sized to accommodate any appropriate number of transdermal patches (e.g., before being folded to capture one or more used transdermal patches therebetween).

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. Transdermal patch packaging, comprising:

a container body;

first and second compartments disposed within said container body;

at least one first transdermal patch in said first compartment, wherein each said first transdermal patch is enclosed within primary packaging and is of an unused condition;

at least one second transdermal patch in said second compartment, wherein each said second transdermal patch is of a used condition; and a lid that controls access to each of said first and second compartments and that is movable between open and closed positions relative to said container body, wherein said lid and said container body are integrally-formed such that said lid and said container body are a one-piece structure; and a hinge between said lid and said container body.

2. The transdermal patch packaging of claim 1, wherein each said first transdermal patch in said first compartment comprises a first amount of medication, wherein each said second transdermal patch in said second compartment comprises a second amount of medication, and wherein said first amount is greater than said second amount.

3. The transdermal patch packaging of claim 1, wherein each said second transdermal patch in said second compartment is in an exposed state.

4. The transdermal patch packaging of claim 1, wherein said container body comprises a first opening to said first compartment, and wherein said first opening is sized to expose each said first transdermal patch currently being stored in said first compartment.

5. The transdermal patch packaging of claim 1, wherein said container body comprises a second opening to said second compartment, and wherein said second opening is sized to expose each said second transdermal patch currently being stored in said second compartment.

6. The transdermal patch packaging of claim 1, further comprising:

a disposal member within said second compartment, wherein at least one said second transdermal patch is bonded to said disposal member.

7. The transdermal patch packaging of claim 1, wherein said container body comprises a first opening to said first compartment, wherein said first opening is sized to expose each said first transdermal patch currently being stored in said first compartment when said lid is in said open position such that a patient may simultaneously access all said first transdermal patches within said first compartment, wherein said container body comprises a second opening to said second compartment, and wherein said second opening is sized to expose each said second transdermal patch currently being stored in said second compartment when said lid is in said open position such that a patient may simultaneously access all said second transdermal patches within said second compartment.

* * * * *